US011852007B2

(12) United States Patent
Wiecek

(10) Patent No.: US 11,852,007 B2
(45) Date of Patent: Dec. 26, 2023

(54) DRILLING SYSTEM WITH DIRECTIONAL SURVEY TRANSMISSION SYSTEM AND METHODS OF TRANSMISSION

(71) Applicant: Halliburton Energy Services, Inc., Houston, TX (US)

(72) Inventor: Boguslaw Wiecek, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 89 days.

(21) Appl. No.: 17/449,482

(22) Filed: Sep. 30, 2021

(65) Prior Publication Data

US 2023/0102885 A1 Mar. 30, 2023

(51) Int. Cl.
*E21B 47/022* (2012.01)
*E21B 47/024* (2006.01)

(52) U.S. Cl.
CPC ..... *E21B 47/022* (2013.01); *E21B 47/024* (2013.01)

(58) Field of Classification Search
CPC ..... E21B 47/022; E21B 47/024
See application file for complete search history.

(56) References Cited

U.S. PATENT DOCUMENTS 5,592,381 A * 1/1997 Henneuse ..... E21B 44/005 702/9
9,291,049 B2 3/2016 Switzer et al.
9,664,038 B2 5/2017 Switzer et al.
9,988,896 B2 6/2018 Switzer et al.
10,151,196 B2 12/2018 Logan et al.
10,215,021 B2 2/2019 Switzer et al.
2004/0163443 A1 8/2004 Mcelhinney
2014/0163888 A1* 6/2014 Bowler ..... E21B 47/022 703/2
2015/0331138 A1 11/2015 Estes et al.
2019/0106982 A1 4/2019 Willerth et al.

FOREIGN PATENT DOCUMENTS

EP 0793000 B1 10/2001
WO 1994016196 A1 7/1994

OTHER PUBLICATIONS

International Search Report and Written Opinion dated Jun. 16, 2022 for corresponding PCT Application No. PCT/US2021/052947 filed Sep. 30, 2021.

* cited by examiner

*Primary Examiner* — Dany E Akakpo
(74) *Attorney, Agent, or Firm* — K&L Gates LLP

(57) ABSTRACT

A downhole drilling system for drilling a wellbore through a subterranean formation and a method of obtaining data from a downhole location. A bottom hole assembly (BHA) is locatable in the wellbore. A gravity sensor is operable to measure the Earth's gravity local to the BHA in three gravity vector coordinates. A magnetic sensor is operable to measure a magnetic field local to the BHA in three magnetic vector coordinates. A downhole processor is locatable in the borehole and operable to, if the gravity or magnetic measurements are not taken at a selected orientation of the BHA, process the measurements downhole by rotating the measured gravity and the measured magnetic field around the z-axis to align a gravity vector or a magnetic vector with the selected orientation of the BHA.

18 Claims, 3 Drawing Sheets

DRILLING SYSTEM WITH DIRECTIONAL SURVEY TRANSMISSION SYSTEM AND METHODS OF TRANSMISSION

BACKGROUND

This section is intended to provide relevant background information to facilitate a better understanding of the various aspects of the described embodiments. Accordingly, these statements are to be read in this light and not as admissions of prior art.

Wellbores drilled into subterranean formations may enable recovery of desirable fluids (e.g., hydrocarbons) using any number of different techniques. Currently, drilling operations may identify subterranean formations using measurements from a bottom hole assembly (BHA). A measurement assembly in the BHA may also operate and/or function to determine the position and trajectory of the BHA in a wellbore within a subterranean formation. For a variety of reasons, operating companies need to know where their wells are as they are being drilled. Many of today's deviated and horizontal wells no longer simply penetrate a reservoir zone but must navigate through it laterally to contact as much of the reservoir as possible. Precise positioning of well trajectories is required to optimize hydrocarbon recovery, determine where each well is relative to the reservoir, and avoid collisions with other wells. To accomplish these objectives, drillers require directional accuracy to within a fraction of a degree.

To achieve this level of accuracy, drillers use tools that include accelerometers and magnetometers that detect the Earth's gravitational and magnetic fields. Typically, the directional surveys are static surveys that are performed at about 100 foot intervals and require a stop in drilling activities for several minutes to obtain the survey. These are then typically done at pipe connections when there is a natural break in drilling process. This limits the number of surveys that can be practically done as stops in drilling activity extend the time of well construction and can cause additional practical difficulties in managing the well pressure and other parameters. Thus, there is a need for providing surveys while drilling that limit or eliminate the need for static surveys and can be provided much more often to aid in guiding the well path.

The surveys normally provide six measurements—three gravity vector measurements in Cartesian coordinate directions x, y, and z, and three magnetic vector measurements in Cartesian coordinate directions x, y, and z—where the z axis of the coordinates is along or parallel to the bottom hole assembly (BHA) center axis in the downhole direction. The x coordinate corresponds to the high side mark on the BHA that is used for controlling drilling direction. Triaxial accelerometers measure the local Earth's gravity along the three orthogonal axes. These measurements provide the inclination of the BHA axis along the wellbore as well as the toolface relative to the high side of the BHA. Similarly, triaxial magnetometers measure the strength of the Earth's magnetic field along three orthogonal axes.

These six vectors are then used to calculate the inclination and azimuth directions of the BHA and thus the wellbore, and are quality checked against the expected, modeled or measured, total field values for Earth's gravity and magnetic field and against the magnetic field dip angle. Since Earth's magnetic field is relatively dynamic there is often need for in field referencing where the Earth's magnetic field is monitored continuously to provide best possible reference. Additionally, the drilling BHAs contain magnetic materials that can interfere with the measurements so appropriate correction algorithms are employed on the surface to correct the measurements to the referenced total field and dip angle. In some cases, few other corrections are made to account for "sag" and other behavior of the BHA to obtain accurate results of the borehole orientation. This normally requires that the gravity and magnetic field x, y, z measurements to be transmitted to the surface.

While drilling the BHA quite often is rotating and currently any continuous orientation measurements are normally calculated downhole by the directional sensor and only the resulting calculated inclination and azimuth are transmitted to the surface with some limited information about the quality of the measurement as ascertained downhole. Since the calculations are done downhole, they rely on the information provided at the surface before the drilling process started for any quality checking. Since the magnetic field is dynamic, the information may be outdated at the time of drilling. Additionally, the computing resources downhole are limited and cannot account for parameters that are only known at the surface on the rig. These include up to date magnetic field and dip angle, and parameters than can affect BHA behavior, such as weight on bit, torque, etc. Therefor it is preferable to transmit the x, y, z measurements to the surface for processing. Typically, all six—three gravity and three magnetic measurements—are obtained and transmitted. In the case of drilling systems, the communication bandwidth is often limited and accuracy requirements for the survey necessitate high-resolution values to be sent, which take significant amount of communication bandwidth. This usually results in transmitting all six values only occasionally, e.g., on pipe connection, or on demand limiting the density of the real time directional measurements, especially if all six values are transmitted.

BRIEF DESCRIPTION OF THE DRAWINGS

Embodiments of the directional survey transmission system and methods are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a drilling system with a directional survey transmission system and methods of transmission. The drilling system includes a bottom hole assembly (BHA) capable of performing directional surveys and transmitting the survey results to the surface. The surveys provide six measurements—three gravity vector measurements in Cartesian coordinate directions x, y, and z, and three magnetic vector measurements in Cartesian coordinate directions x, y, and z—where the z-axis of the coordinates is along or parallel to the BHA center axis in the downhole direction. The x coordinate corresponds to the high side mark on the BHA that is used for controlling drilling direction. A triaxial accelerometer measure the local Earth's gravity along the three orthogonal axes. These measurements provide the inclination of the BHA axis along the wellbore as well as the toolface relative to the high side of the BHA. Similarly, a triaxial magnetometer measures the strength of the Earth's magnetic field along three orthogonal axes local to the BHA.

Figure 1:
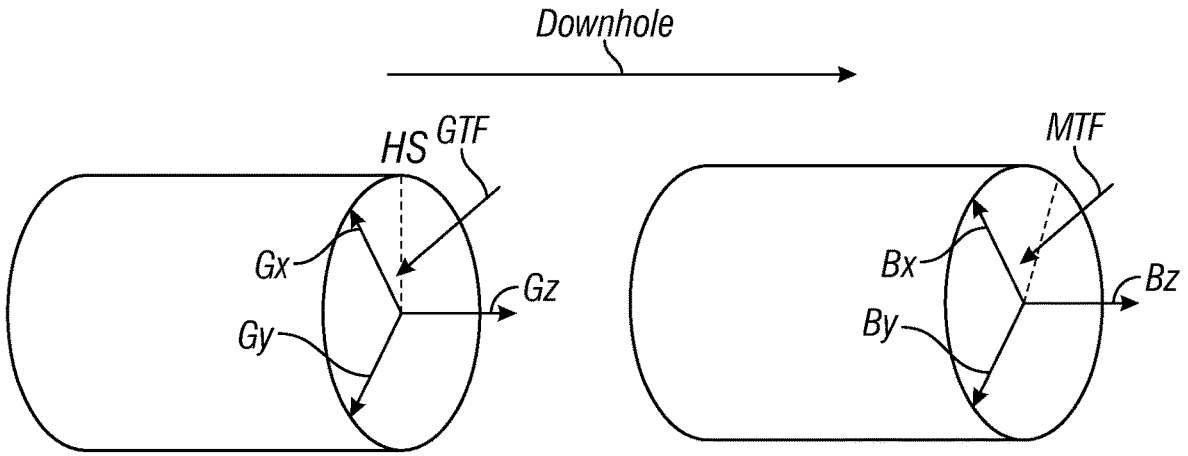
FIG. 1 illustrates coordinate systems for a directional survey model.

To minimize the use of the communication bandwidth between the BHA and the surface, the number of bits transmitted are reduced while preserving information necessary for accurate calculation of inclination, azimuth, and quality factors on the surface. As illustrated in FIG. 1, the directional survey includes the values, $G_x$, $G_y$ and $G_z$, in Cartesian coordinates for gravity measurement and the values, $B_x$, $B_y$, and $B_z$, in Cartesian coordinates for magnetic field measurement. These six values are measured downhole using a gravity sensor and a magnetic sensor, respectfully. However, since the inclination and azimuth of the BHA are normally independent of the rotational orientation, or tool face, of the BHA and the six values contain the tool face information, the amount of information transmitted can be reduced by choosing to send the information for an arbitrary selected fixed orientation of the BHA. For example, by choosing a fixed high side (gravity) tool face (GTF) of 0°, the measured six values can be adjusted to the fixed tool face by rotating the measured vectors around the z-axis to the high side tool face of 0°. This will cause the $B_y$ measurement to be zero and it is unnecessary to transmit that value as it is by design always zero. Any other fixed value of tool face, whether high side or magnetic may be used for the selected orientation of the BHA. Alternatively, the measurements can be adjusted to the magnetic tool face (MTF) of 0°, causing the $B_y$ component to be fixed always at 0 and likewise not transmit the known value. Either method will then reduce the transmission of six values to five values, reducing the bandwidth requirement by $1/6^{th}$ or approximately 17%. The fixed tool face does not have to be 0° as long as it is known then one of the X,Y components does not need to be transmitted.

As an example, by calculating the gravity tool face (GTF) downhole using a downhole processor, the measured x-axis and y-axis measurements can then be rotated to obtain a new set of rotated measurements $G_x'$, $G_y'$, $B_x'$, and $B_y'$ as follows:

$$\begin{bmatrix} G_x' \\ G_y' \end{bmatrix} = \begin{bmatrix} \cos(GTF) & \sin(GTF) \\ -\sin(GTF) & \cos(GTF) \end{bmatrix} \cdot \begin{bmatrix} G_x \\ G_y \end{bmatrix} \quad \text{Eq. 1}$$

and $$\begin{bmatrix} B_x' \\ B_y' \end{bmatrix} = \begin{bmatrix} \cos(GTF) & \sin(GTF) \\ -\sin(GTF) & \cos(GTF) \end{bmatrix} \cdot \begin{bmatrix} B_x \\ B_y \end{bmatrix} \quad \text{Eq. 2}$$

Then by definition of GTF, the $G_y'$ component is zero within predefined accuracy and does not need to be transmitted to the surface, reducing the set of measurements to be transmitted to five values: $G_x'$, $G_z$, $B_x'$, $B_y'$, and $B_z$. A surface processor at the surface receiving the transmitted data can add the missing $G_y'$ value, as it is predefined to be zero, to complete the measurements to the full six measurements.

As an alternative example, by calculating magnetic tool face (MTF) downhole using a downhole processor, the measured x-axis and y-axis measurements can then be rotated to obtain a new set of rotated measurements $G_x'$, $G_y'$, $B_x'$, and $B_y'$ as follows:

$$\begin{bmatrix} G_x' \\ G_y' \end{bmatrix} = \begin{bmatrix} \cos(MTF) & \sin(MTF) \\ -\sin(MTF) & \cos(MTF) \end{bmatrix} \cdot \begin{bmatrix} G_x \\ G_y \end{bmatrix} \quad \text{Eq. 3}$$

and $$\begin{bmatrix} B_x' \\ B_y' \end{bmatrix} = \begin{bmatrix} \cos(MTF) & \sin(MTF) \\ -\sin(MTF) & \cos(MTF) \end{bmatrix} \cdot \begin{bmatrix} B_x \\ B_y \end{bmatrix} \quad \text{Eq. 4}$$

Then by definition of GTF, the $B_y'$ component is zero within predefined accuracy and does not need to be transmitted reducing the set to five values: $G_x'$, $G_y'$, $G_z$, $B_x'$ and $B_z$. A surface processor at the surface receiving the transmitted data can add the missing $B_y'$ value, as it is predefined to be zero, to complete the measurements to the full six measurements In the case of a rotating BHA, such as while drilling a borehole, the GTF and MTF are constantly changing so the measurements can be either continuously adjusted to the selected tool face (either gravity or magnetic) or chosen such that GTF or MTF at the time of measurement is 0° and multiple of such adjusted measurements can be averaged or filtered. For example, a simple average can be used:

$$G_x' = \frac{1}{N} \cdot \sum_{i=1}^{N} G_{x_i}',\ G_y' = \frac{1}{N} \cdot \sum_{i=1}^{N} G_{y_i}',\ G_z' = \frac{1}{N} \cdot \sum_{i=1}^{N} G_{z_i}' \quad \text{Eq. 5}$$

$$B_x' = \frac{1}{N} \cdot \sum_{i=1}^{N} B_{x_i}',\ B_y' = \frac{1}{N} \cdot \sum_{i=1}^{N} B_{y_i}',\ B_z' = \frac{1}{N} \cdot \sum_{i=1}^{N} B_{z_i}' \quad \text{Eq. 6}$$

If the adjustment of the measurements is done to MTF=0 then $B_y'=0$ and does not need to be averaged. Conversely if adjustment of the samples is done to GTF=0 then $G_y'=0$ and does not need to be averaged.

Alternatively, a $G_{oxy}$, $B_{oxy}$ and $\varphi$=GTF−MTF can be calculated and then by choosing GTF=0° (or any other predefined value), or by choosing MTF=0° (or any other predefined value), the same five values may be obtained for the calculation of the inclination and azimuth, either downhole or on the surface. For GTF=0°:

$$G'_x = G'_{oxy},\ G'_y = 0 \quad \text{Eq. 7}$$

Then:

$$\begin{bmatrix} B_x' \\ B_y' \end{bmatrix} = \begin{bmatrix} \cos(\varphi) & \sin(\varphi) \\ -\sin(\varphi) & \cos(\varphi) \end{bmatrix} \cdot \begin{bmatrix} B_x \\ B_y \end{bmatrix} \quad \text{Eq. 8}$$

Where: $B_x=B_{oxy}$ and $B_y=0$. Thus, $B_x'=B_{oxy}\cdot\cos(\varphi)$ and $B_y'=B_{oxy}\cdot\sin(\varphi)$. The set of five adjusted measurements may then be transmitted to the surface.

When frequently transmitting the surveys the set of five values can be subsequently followed by the differences in value from the five values transmitted. Since the changes in inclination and azimuth are relatively slow, the differences in value can have a limited range, further reducing the telemetry bandwidth requirements for surveys. For example, assuming a 14-bit resolution for the surveys, then the full 14-bit resolution set of five values is followed by an 8-bit set of five values that contain only the differences in value of the new survey to the previously transmitted 14-bit survey. The resolution of the 8-bit differences in value can be the same as 14-bit but then the range of the differences will be limited. If, however, the differences in value between a previous 14-bit survey and a new survey exceeds the range of the 8-bit delta values a new 14-bit set of values can be transmitted followed again by the differences in value from the new 14-bit survey. A new 14-bit set of values may also be transmitted after a specified period of time, a break in transmission, or any other selected condition. In these examples, the 14-bit and 8-bit choices are arbitrary and can be different depending on the telemetry and requirements on resolution and ranges.

To ensure integrity and synchronization of the full range surveys with limited range survey deltas the transmitted values may need to contain a sequence number/id as well as other status or error indicators. This allows for efficient transmission of the gravity and magnetic field measurements for obtaining borehole orientation or drill string orientation. Since the measured components are transmitted, any corrections due to drill string interference, magnetic modeling, in filed referencing and similar can be done on the surface using the existing standard methods. In case of frequent directional survey measurements, this method allows for the higher frequency transmission of the measured field components for the same bandwidth of the telemetry.

Figure 2:
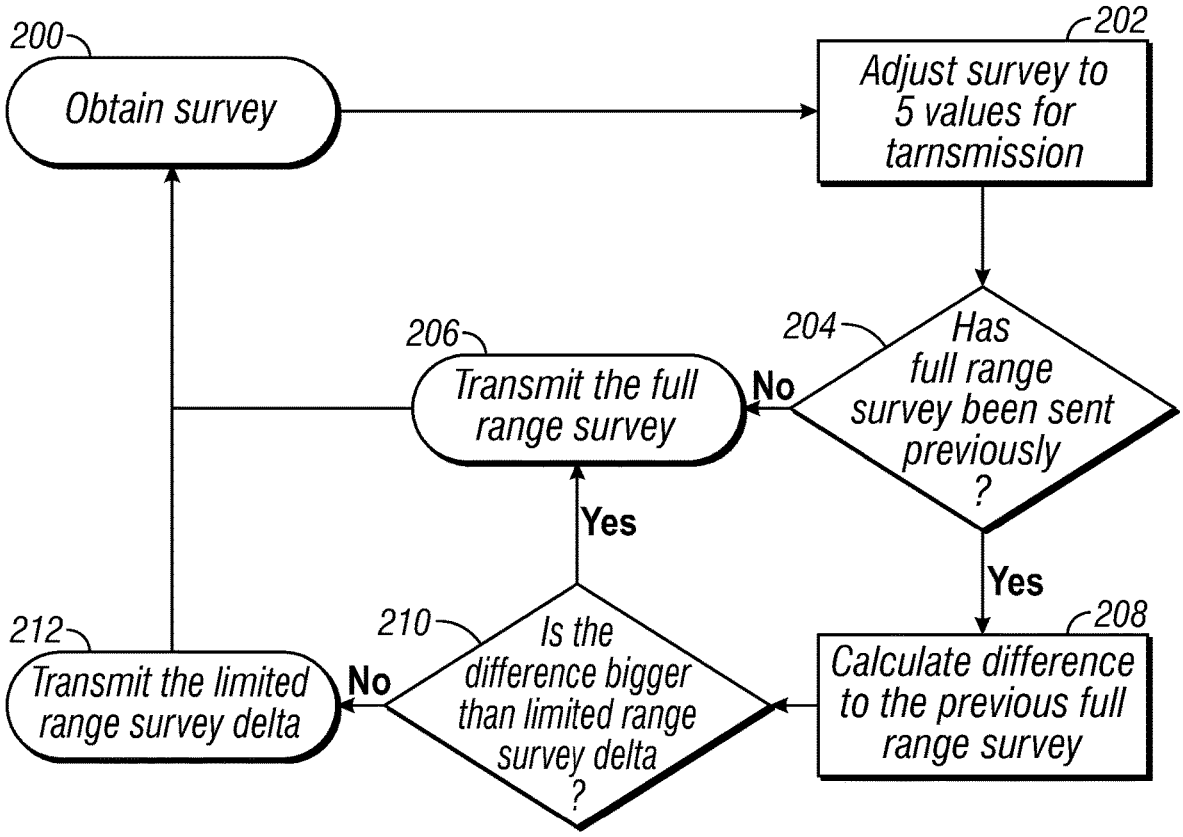
FIG. 2 illustrates a workflow for determining survey data to be transmitted.

The example sequence is shown graphically in FIG. 2, where at step 200, a survey is obtained using the gravity and magnetic sensors. The measurements are then processed to obtain the five measurement vectors to be transmitted to the surface at step 202. If the survey is taken after a pumps on condition indicating restarting operations after a connection, the full range survey is transmitted. Otherwise, at step 204, the downhole processor determines whether a full range survey of five values has been transmitted to the surface recently, e.g., in the last 10 minutes, at step 204. If not, the full range survey of five values from step 202 is transmitted to the surface at step 206. If so, then the downhole processor calculates the differences in value of the current full range survey and the previous full range survey at step 208. Then, the processor determines if the differences in value is larger than the limited range survey differences in value at step 210. If not, then the limited range of survey differences in value are transmitted to the surface at step 212. If so, then the full range survey of five values from step 202 is transmitted to the surface at step 206. Sometime after transmitting the full range survey of five values at step 206 or the limited range survey differences in value at 212, the process is repeated at step 200 by obtaining another survey.

Figure 3:
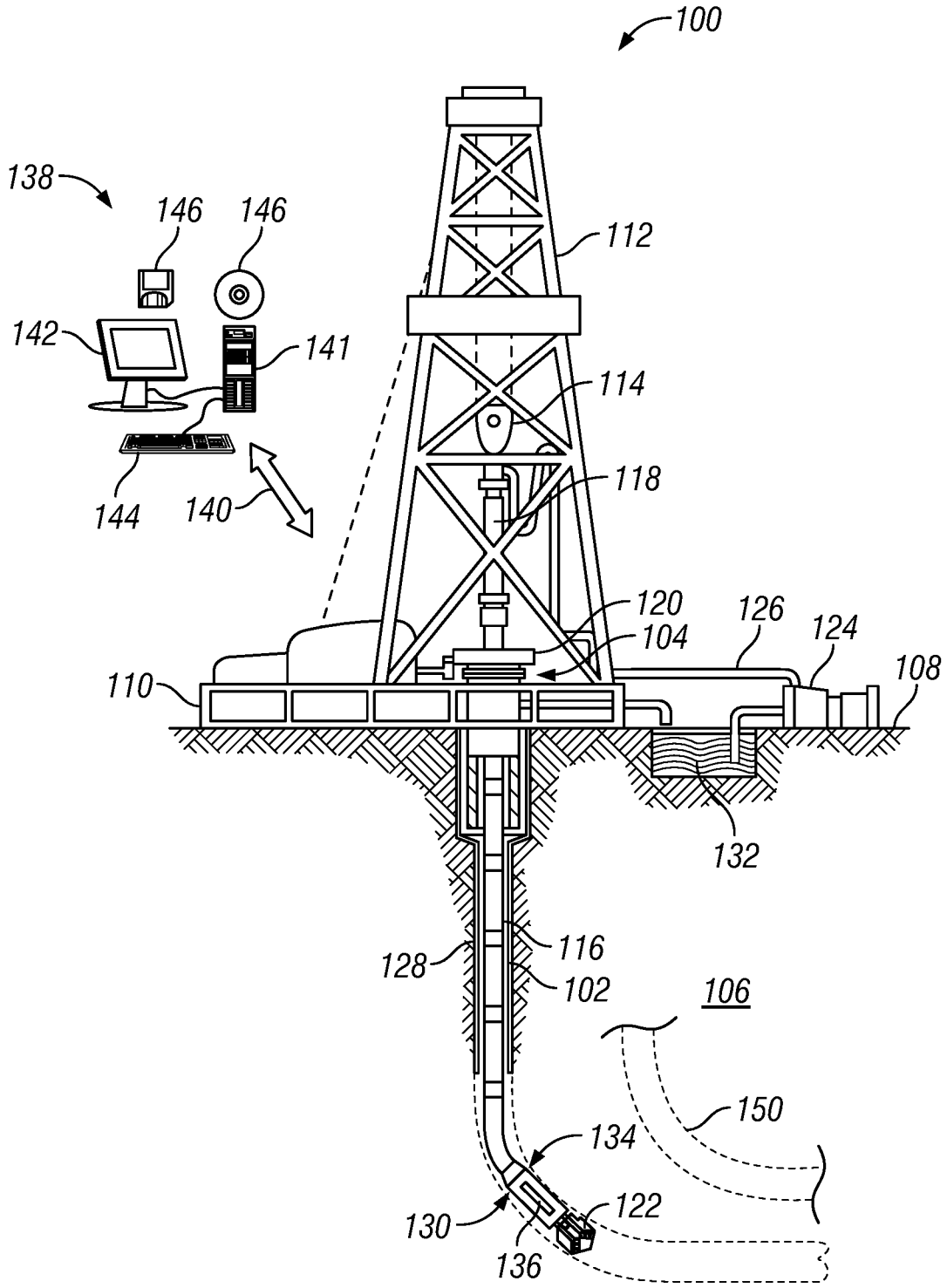
FIG. 3 illustrates an example system used with a drilling system for wellbore collision avoidance or intersection ranging.

FIG. 3 illustrates an example of a drilling system 100 for performing directional survey transmission to a surface 108. As illustrated, a wellbore 102 being drilled may extend from a wellhead 104 into and through a subterranean formation 106 from the surface 108. Generally, the wellbore 102 being drilled may include horizontal, vertical, slanted, curved, and other types of wellbore geometries and orientations. For example, although FIG. 3 illustrates a vertical or low inclination angle well, high inclination angle or horizontal placement of the well and equipment may be possible. The wellbore 102 may be cased or uncased. In examples, the wellbore 102 may include a metallic member. By way of example, the metallic member may be a casing, liner, tubing, or other elongated steel tubular disposed in the wellbore 102.

It should be further noted that while FIG. 3 generally depicts land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. The drill string 116 may include, but is not limited to, drill pipe and coiled tubing, as generally known to those skilled in the art. A kelly 118 may support the drill string 116 as it may be lowered through a rotary table 120. A drill bit 122 may be attached to the distal end of the drill string 116 and may be driven either by a downhole motor and/or via rotation of the drill string 116 from the surface 108. Without limitation, the drill bit 122 may include, roller cone bits, PDC bits, natural diamond bits, any hole openers, reamers, coring bits, and the like. As the drill bit 122 rotates, it may create and extend the wellbore 102 that penetrates various subterranean formations 106. A pump 124 may circulate drilling fluid through a feed pipe 126 through kelly 118, downhole through an interior of the drill string 116, through orifices in the drill bit 122, back to the surface 108 via an annulus 128 surrounding the drill string 116, and into a retention pit 132.

The drill string 116 may begin at the wellhead 104 and may traverse the wellbore 102. The drill bit 122 may be attached to a distal end of the drill string 116 and may be driven, for example, either by a downhole motor and/or via rotation of the drill string 116 from the surface 108. The drill bit 122 may be a part of bottom hole assembly (BHA) 130 at a distal end of the drill string 116. It should be noted that BHA 130 may also be referred to as a downhole tool. The BHA 130 may further include tools for look-ahead resistivity applications. As will be appreciated by those of ordinary skill in the art, the BHA 130 may be a measurement-while drilling (MWD) or logging-while-drilling (LWD) system. The BHA 130 may also include directional drilling and measuring equipment such as a push-the-bit or point-the-bit rotary steerable systems, for examples.

Without limitation, the BHA 130 may be connected to and/or controlled by an information handling system 138, which may be disposed on the surface 108. The information handling system 138 may communicate with the BHA 130 through a communication line (not illustrated) disposed in (or on) the drill string 116. In examples, wireless communication may be used to transmit information back and forth between the information handling system 138 and the BHA 130. The information handling system 138 may transmit information to the BHA 130 and may receive as well as process information recorded by the BHA 130. In examples, a downhole information handling system (not illustrated) may include, without limitation, a microprocessor or other suitable circuitry, for estimating, receiving and processing signals from the BHA 130. The downhole information handling system (not illustrated) may further include additional components, such as memory, input/output devices, interfaces, and the like. In examples, while not illustrated, the BHA 130 may include one or more additional components, such as analog-to-digital converter, filter and amplifier, among others, that may be used to process the measurements of the BHA 130 before they may be transmitted to the surface 108 using a transmission system that may be part of the BHA 130. Alternatively, raw measurements from the BHA 130 may be transmitted to the surface 108 using the transmission system.

Any suitable technique may be used for transmitting signals from the BHA 130 to surface 108, including, but not limited to, wired pipe telemetry, mud-pulse telemetry, acoustic telemetry, and electromagnetic telemetry. While not separately illustrated, the BHA130 may include the transmission system that may transmit telemetry data to the surface 108. At the surface 108, pressure transducers (not shown) may convert the pressure signal into electrical signals for a digitizer (not illustrated). Oher sensors may also be used at the surface to receive transmitted data from downhole. The digitizer may supply a digital form of the telemetry signals to information the information handling system 138 via a communication link 140, which may be a wired or wireless link. The telemetry data may then be analyzed and processed by the information handling system 138.

As illustrated, a communication link 140 (which may be wired or wireless, for example) may be provided that may transmit data from the BHA130 to the information handling system 138 at the surface 108. The information handling system 138 may also include a personal computer 141, a video display 142, a keyboard 144 (i.e., other input devices.), and/or non-transitory computer-readable media 146 (e.g., optical disks, magnetic disks) that can store code representative of the methods described herein. In addition to, or in place of processing at the surface 108, processing may occur downhole.

The information handling system 138 may be used to perform methods to determine properties of the BHA 130 and the wellbore. Information may be utilized to produce an image, which may be generated into a two- or three-dimensional model of the subterranean formation 106. These models may be used for well planning, (e.g., to design a desired path of the wellbore 102). Additionally, they may be used for planning the placement of drilling systems within a prescribed area. This may allow the most efficient drilling operations to reach a subsurface structure. During drilling operations, measurements taken with the surface tracking system 100 may be used to adjust the geometry of the wellbore 102, or steer the drilling system 101, in real time to reach or avoid a non-geological target, such as another wellbore.

As an example, the BHA 130 may comprise any number of tools, transmitters, and/or receivers to perform downhole measurements. For example, the BHA 130 may include a measurement assembly 134. It should be noted that the measurement assembly 134 may make up at least a part of the BHA 130. Without limitation, any number of different measurement systems, communication or transmission systems, battery systems, and/or the like may form the BHA 130 with the measurement assembly 134. Additionally, the measurement assembly 134 may form the BHA 130 itself.

In examples, the measurement assembly 134 may comprise at least one gravity sensor and at least one magnetic sensor for performing directional surveys as discussed above. The gravity sensor measures gravity gradients of the subsurface formation 106 that can be used to detect the inclination and azimuth of the BHA 130 and thus the trajectory of the wellbore 102 being drilled. The data measured by the gravity sensor may then be transmitted to the surface using a transmission system that is part of the BHA 130 and the communicated to the information handling system 138 via the communication link 140, which may be a wired or wireless communication link. The transmitted data may include the reduced data sets of five values, the difference between a current survey and a previous survey, or limited range survey differences in value. The data may then be processed by the information handling system 138 to determine the inclination and azimuth of the BHA 130 and the trajectory of the wellbore 102 being drilled. This information may then be used to send control commands back downhole to the BHA 130 to adjust the trajectory of the wellbore 102 by adjusting the trajectory of the BHA 130.

The systems and methods may also be used for avoiding a non-geological target, such as another, previously drilled wellbore. For example, as shown in FIG. 3, a second wellbore 150 extends through the formation 106. Knowing the inclination and azimuth of the wellbore 102, the trajectory of the BHA 130 may be controlled in a manner useable for geosteering applications in directional drilling to avoid intersecting the second wellbore 150. For example, commands can be transmitted downhole to either maintain the drill bit 122 on a current trajectory or steered in a different direction. The information handling system 138 may thus control the trajectory of the BHA 130 and thus the wellbore 102 to avoid the second wellbore 150 using the steering capabilities of the BHA 130.

Examples of the disclosure include the following:

Example 1. A method of obtaining data at a downhole location, including measuring the Earth's gravity local to a bottom hole assembly (BHA) at the downhole location in three gravity vector coordinates using a gravity sensor downhole, wherein a gravity z-axis vector is parallel with the center axis of the BHA in the downhole direction. The example method also includes measuring the Earth's magnetic field local to the BHA in three magnetic vector coordinates using a magnetic sensor downhole, wherein a magnetic field z-axis vector is parallel with the center axis of the BHA in the downhole direction. If the measurements are not taken at a selected orientation of the BHA, the measurements are processed downhole using a downhole processor by rotating the measured gravity and the measured magnetic field around the z-axis to align a gravity vector or a magnetic vector with the selected orientation of the BHA.

Example 2. The method of Example 1, further comprising transmitting the non-aligned gravity vectors and non-aligned magnetic vectors to the surface using a transmission system without transmitting the aligned gravity vector or the aligned magnetic vector.

Example 3. The method of Example 2, further comprising calculating continuous orientation measurements of the BHA downhole with a surface processor using the data transmitted with the transmission system and the selected orientation of the BHA to determine inclination and azimuth of the BHA.

Example 4. The method of Example 1, further comprising taking and processing multiple gravity and magnetic measurements and averaging the processed measurements using the downhole processor.

Example 5. The method of Example 4, further comprising transmitting the averaged non-aligned gravity vectors and averaged non-aligned magnetic vectors to the surface without transmitting the aligned gravity vector or the aligned magnetic vector.

Example 6. The method of Example 1, further comprising taking the measurements while drilling a wellbore through a subterranean formation.

Example 7. The method of Example 3, further comprising taking the measurements while the sensors are rotating around the z-axis.

Example 8. The method of Example 1, wherein the selected orientation of the BHA is either a gravity tool face or a magnetic tool face.

Example 9. The method of Example 1, further comprising taking and processing multiple gravity and magnetic measurements and averaging the processed measurements using the downhole processor.

Example 10. The method of Example 1, further comprising taking and processing additional gravity and magnetic measurements; determining the differences in value between two different measurements; if the differences in value are outside a range of differences, transmitting the non-aligned gravity vectors and non-aligned magnetic vectors of one of the measurements to the surface using the transmission system without transmitting the aligned gravity vector or the aligned magnetic vector; and if the differences in value are within a range of differences, transmitting only the differences in value between the two different measurements to the surface using a transmission system.

Example 11. A downhole drilling system for drilling a wellbore through a subterranean formation, comprising: a bottom hole assembly (BHA) locatable in the wellbore; a gravity sensor operable to measure the Earth's gravity local to the BHA in the subterranean formation in three gravity vector coordinates, wherein a gravity z-axis vector is parallel with the center axis of the BHA in the downhole direction; a magnetic sensor operable to measure a magnetic field local to the BHA in the subterranean formation in three magnetic vector coordinates, wherein a magnetic field z-axis vector is parallel with the center axis of the BHA in the downhole direction; and a downhole processor locatable in the borehole and operable to, if the gravity or magnetic measurements are not taken at a selected orientation of the BHA, process the measurements downhole by rotating the measured gravity and the measured magnetic field around the z-axis to align a gravity vector or a magnetic vector with the selected orientation of the BHA.

Example 12. The system of Example 11, further comprising a transmission system operable to transmit the non-aligned gravity vectors and non-aligned magnetic vectors to the surface using a transmission system without transmitting the aligned gravity vector or the aligned magnetic vector Example 13. The system of Example 12, further comprising a surface processor located at the surface and operable to calculate continuous orientation measurements of the BHA downhole using the data transmitted with the transmission system and the selected orientation of the BHA to determine inclination and azimuth of the BHA.

Example 14. The system of Example 11, wherein the gravity sensor and the magnetic sensor are operable to make multiple measurements and the downhole processor is operable to process the multiple gravity and magnetic measurements and average the processed measurements.

Example 15. The system of Example 14, further comprising a transmission system operable to transmit the averaged non-aligned gravity vectors and averaged non-aligned magnetic vectors to the surface without transmitting the aligned gravity vector or the aligned magnetic vector.

Example 16. The system of Example 11, wherein the gravity sensor and the magnetic sensor are further operable to take the measurements while drilling borehole through a subterranean formation.

Example 17. The system of Example 11, wherein the gravity sensor and the magnetic sensor are further operable to take the measurements while the sensors are rotating around the z-axis.

Example 18. The system of Example 11, wherein the selected orientation of the BHA is either a gravity tool face or a magnetic tool face.

Example 19. A method of drilling a borehole through a subterranean formation, comprising: drilling the borehole using a drill bit that is part of a bottom hole assembly (BHA); measuring the Earth's gravity local to the BHA in three gravity vector coordinates using a gravity sensor downhole, wherein a gravity z-axis vector is parallel with the center axis of the BHA in the downhole direction; measuring the Earth's magnetic field local to the BHA in three magnetic vector coordinates using a magnetic sensor downhole, wherein a magnetic field z-axis vector is parallel with the center axis of the BHA in the downhole direction; if the measurements are not taken at a selected orientation of the BHA, processing the measurements downhole using a downhole processor by rotating the measured gravity and the measured magnetic field around the z-axis to align a gravity vector or a magnetic vector with the selected orientation of the BHA; transmitting the non-aligned gravity vectors and non-aligned magnetic vectors to the surface using a transmission system without transmitting the aligned gravity vector or the aligned magnetic vector; calculating continuous orientation measurements of the BHA downhole with a surface processor at the surface using the data transmitted with the transmission system and the selected orientation of the BHA to determine inclination and azimuth of the BHA; and transmitting commands from the surface processor to the BHA to steer the BHA and drill the borehole further.

Example 20. The method of Example 19, further comprising processing the measurements downhole by rotating both the measured gravity and the measured magnetic field around the z-axis to align both the gravity vectors and the magnetic vectors with the selected orientation of the BHA.

Example 21. The method of Example 19, further comprising taking the measurements while drilling a wellbore through a subterranean formation.

Example 22. The method of Example 19, further comprising taking the measurements while the sensors are rotating.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

While compositions and methods are described herein in terms of "comprising" various components or steps, the compositions and methods can also "consist essentially of" or "consist of" the various components and steps.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques accepted by those skilled in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of obtaining data at a downhole location in a wellbore, comprising:

taking multiple surveys, wherein each survey comprises:

taking a gravity measurement of the Earth's gravity local to a bottom hole assembly (BHA) at the downhole location in three gravity vector coordinates using a gravity sensor downhole, wherein a gravity z-axis vector is parallel with a center axis of the BHA in a downhole direction; and taking a magnetic field measurement of the Earth's magnetic field local to the BHA in three magnetic vector coordinates using a magnetic sensor downhole, wherein a magnetic field z-axis vector is parallel with the center axis of the BHA in the downhole direction; and if the measurements are not taken at a selected orientation of the BHA, processing the surveys downhole using a downhole processor by:

rotating the gravity vectors and the magnetic vectors of each survey together around the z-axes to align a chosen gravity or magnetic vector with the selected orientation of the BHA such that each survey is aligned with the selected orientation; and averaging the vectors of the aligned surveys by measurement and by axis.

2. The method of claim 1, further comprising transmitting data including the averages of the vectors to the surface using a transmission system without transmitting the average of the chosen vectors.

3. The method of claim 2, further comprising continuously calculating inclination and azimuth of the BHA downhole using a surface processor using the data transmitted with the transmission system.

4. The method of claim 3, further comprising taking the surveys while the gravity and magnetic sensors are rotating around the z-axes.

5. The method of claim 2, further comprising continuously calculating inclination and azimuth of the BHA downhole using a downhole processor and transmitting the calculated inclination and azimuth to the surface using the transmission system.

6. The method of claim 1, further comprising taking the surveys while drilling the wellbore through a subterranean formation.

7. The method of claim 1, wherein the selected orientation of the BHA is either a gravity tool face or a magnetic tool face.

8. The method of claim 1, further comprising:

determining the differences in value between two different measurements;

if the differences in value are outside a range of differences, transmitting non-chosen vectors of one of the surveys to the surface using a transmission system without transmitting the chosen vector; and if the differences in value are within the range of differences, transmitting only the differences in value of the non-chosen vectors between the two different surveys to the surface using the transmission system.

9. A downhole drilling system for drilling a wellbore through a subterranean formation, comprising:

a bottom hole assembly (BHA) locatable in the wellbore;

a gravity sensor operable to, for each of multiple surveys, take a gravity measurement of the Earth's gravity local to the BHA in the subterranean formation in three gravity vector coordinates, wherein a gravity z-axis vector is parallel with a center axis of the BHA in a downhole direction;

a magnetic sensor operable to, for each of the multiple surveys, take a magnetic field measurement of a magnetic field local to the BHA in the subterranean formation in three magnetic vector coordinates, wherein a magnetic field z-axis vector is parallel with the center axis of the BHA in the downhole direction; and a downhole processor locatable downhole in the wellbore and operable to, if the gravity or magnetic measurements are not taken at a selected orientation of the BHA, process the surveys downhole by:

rotating the gravity vectors and the magnetic vectors of each survey together around the z-axes to align a chosen gravity or magnetic vector with the selected orientation of the BHA such that each survey is aligned with the selected orientation; and averaging the vectors of the aligned surveys by measurement and by axis.

10. The system of claim 9, further comprising a transmission system operable to transmit data including the averages of the vectors to the surface without transmitting the average of the chosen vectors.

11. The system of claim 10, further comprising a surface processor located at the surface and operable to continuously calculate the inclination and azimuth of the BHA downhole using the data transmitted with the transmission system.

12. The system of claim 10, wherein:

the downhole processor is further operable to continuously calculate inclination and azimuth of the BHA downhole; and the transmission system is further operable to transmit the calculated orientation to the surface.

13. The system of claim 9, wherein the gravity sensor and the magnetic sensor are further operable to take the surveys while drilling the wellbore.

14. The system of claim 9, wherein the gravity sensor and the magnetic sensor are further operable to take the surveys while the sensors are rotating around the z-axes.

15. The system of claim 9, wherein the selected orientation of the BHA is either a gravity tool face or a magnetic tool face.

16. A method of drilling a wellbore through a subterranean formation, comprising:

drilling the wellbore using a drill bit that is part of a bottom hole assembly (BHA);

taking multiple surveys, wherein each survey comprises:

taking a gravity measurement of the Earth's gravity local to the BHA in three gravity vector coordinates using a gravity sensor downhole, wherein a gravity z-axis vector is parallel with a center axis of the BHA in a downhole direction; and taking a magnetic field measurement of the Earth's magnetic field local to the BHA in three magnetic vector coordinates using a magnetic sensor downhole, wherein a magnetic field z-axis vector is parallel with the center axis of the BHA in the downhole direction;

if the measurements are not taken at a selected orientation of the BHA, processing the surveys downhole using a downhole processor by:

rotating the gravity vectors and the magnetic vectors of each survey together around the z-axes to align a chosen gravity or magnetic vector with the selected orientation of the BHA such that each survey is aligned with the selected orientation;

averaging the vectors of the aligned surveys by measurement and by axis;

transmitting data including the averages of the vectors to the surface using a transmission system without transmitting the average of the chosen vectors;

calculating the inclination and azimuth of the BHA downhole continuously using a surface processor at the surface using the data transmitted with the transmission system; and transmitting commands from the surface processor to the BHA to steer the BHA and drill the wellbore further.

17. The method of claim 16, further comprising taking the surveys while drilling the wellbore through the subterranean formation.

18. The method of claim 16, further comprising taking the surveys while the gravity and magnetic sensors are rotating around the z-axes.

* * * * *